US008469200B2

(12) United States Patent
Wendeln

(10) Patent No.: US 8,469,200 B2
(45) Date of Patent: Jun. 25, 2013

(54) DEVICE AND METHOD FOR LINEARLY SORTING ARTICLES OF VARYING SIZE

(75) Inventor: Fred Wendeln, New Bremen, OH (US)

(73) Assignee: Honda Motor Co., Ltd., Tokyo (JP)

( * ) Notice: Subject to any disclaimer, the term of this patent is extended or adjusted under 35 U.S.C. 154(b) by 61 days.

(21) Appl. No.: 13/069,441

(22) Filed: Mar. 23, 2011

(65) Prior Publication Data

US 2012/0241364 A1 Sep. 27, 2012

(51) Int. Cl.
*B07C 5/02* (2006.01)

(52) U.S. Cl.
USPC ..... 209/539; 209/44.3; 209/674; 209/680

(58) Field of Classification Search
USPC ..... 209/539, 634, 659, 680
See application file for complete search history.

(56) References Cited

U.S. PATENT DOCUMENTS

| | | | | | |
|---|---|---|---|---|---|
| 2,359,890 | A | | 10/1944 | Birdsall | |
| 2,501,403 | A | * | 3/1950 | McKinsey | 209/539 |
| 3,389,790 | A | | 6/1968 | Braunheim et al. | |
| 3,498,452 | A | * | 3/1970 | Gunthert et al. | 209/539 |
| 3,701,418 | A | * | 10/1972 | Chapman | 209/674 |
| 4,620,634 | A | * | 11/1986 | Takiguchi | 209/44.3 |
| 4,714,397 | A | * | 12/1987 | Ohkuma et al. | 414/226.05 |
| 6,460,707 | B2 | * | 10/2002 | Boyer | 209/680 |

* cited by examiner

*Primary Examiner* — Terrell Matthews
(74) *Attorney, Agent, or Firm* — Standley Law Group LLP

(57) ABSTRACT

A device for sorting a plurality of articles which vary in size by linearly translating the articles over a plurality of apertures that also vary in size. An article may be accepted into a guide that releasably retains the article while the guide and the article are linearly translated across a sorting surface by an actuator until the article falls through an aperture for which the article was intended. The article is supported from below by a support surface. The sorting surface may be angled relative to the horizontal plane to facilitate passage of the articles through the apertures. The base portion of the article may slide along the support surface as the guide translates the article across the sorting surface.

23 Claims, 5 Drawing Sheets

DEVICE AND METHOD FOR LINEARLY SORTING ARTICLES OF VARYING SIZE

TECHNICAL FIELD

The embodiments herein are generally directed to a device for sorting articles having varying dimensional attributes. More particularly, the embodiments are directed toward a device that can translate articles linearly across a number of apertures for sorting.

BACKGROUND

During various manufacturing or other processes, it may be desirable to sort a number of different sized articles into groups. Of course, efficiency is always a concern in manufacturing processes so, in such a case, it may be desirable to sort the articles in the fastest manner possible. Traditionally, sorting processes for such articles have been performed manually by an operator who measures each article and places each article into a respective sorting bin or storage container of some type for later use. Measuring each article with a traditional measuring device (calipers, scale, tape measure, etc.) is time consuming and prone to operator error. Jigs or measuring blocks have been used to speed up the process, but are still prone to operator error and are tedious to use.

Previous attempts to automate the sorting process have used rotating devices of circular or conical shape to continually and simultaneously circulate a multitude of articles to be sorted over a series of underlying holes through which the articles eventually fall. While experiencing some level of success, these devices fall short in several notable ways. Mainly, these devices cannot handle articles that vary only slightly in their dimensional attributes (i.e., when there is only a small dimensional difference between the various articles being sorted). Further, the articles sorted by such a device are caused to bounce around and travel through a relatively traumatic sorting process. This is not conducive to sensitive articles that are prone to damage or require delicate handling. This process also commonly requires that a given article be circulated many times before finally passing through an intended sorting hole.

SUMMARY OF THE GENERAL INVENTIVE CONCEPT

The embodiments described herein are illustrative of devices for sorting a plurality of articles that vary in size by linearly translating the articles over a sorting surface having a plurality of apertures that also vary in size. An article may be accepted into a guide that releasably holds the article while the guide and article are linearly translated across an apertured sorting surface by an actuator. During translation and sorting, the article may be supported from below by a primary support surface. The base portion of the article being sorted may slide along the primary support surface as the guide moves the article across the sorting surface. The primary support surface and the sorting surface may be angled relative to the horizontal plane to allow gravity to assist with passage of the articles to be sorted through respective sorting apertures. The article falls through the first aperture in the sorting surface that is large enough to allow the article to pass.

After passing through an intended aperture, the article may be directed into an exit tube or other directing element for deposit in a sorting bin/container or for transfer to another location and/or process. For example, a loading tube may be used to accept the articles for sorting and to direct the articles into the guide. Preferably, the guide travels from a beginning position to an ending position and the apertures are placed in order from smallest to largest with respect to the direction of travel of the guide. The articles may slide, roll, or move in some combination thereof along the support surfaces while being translated over the sorting apertures.

The articles may have any type of cross-sectional geometry and may be sorted by their relative overall lengths, widths, etc. Each article may have the same or a similar cross-sectional geometry, or the cross-sectional geometry may vary among the articles to be sorted. Any number of different articles may be sorted by placing a corresponding number of appropriately sized apertures in the sorting surface. Since the linear sorting process is precisely controlled, articles that vary only slightly in a given dimension can be accurately, quickly, and repeatably sorted.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF EXEMPLARY EMBODIMENT(S)

Figure 1A:
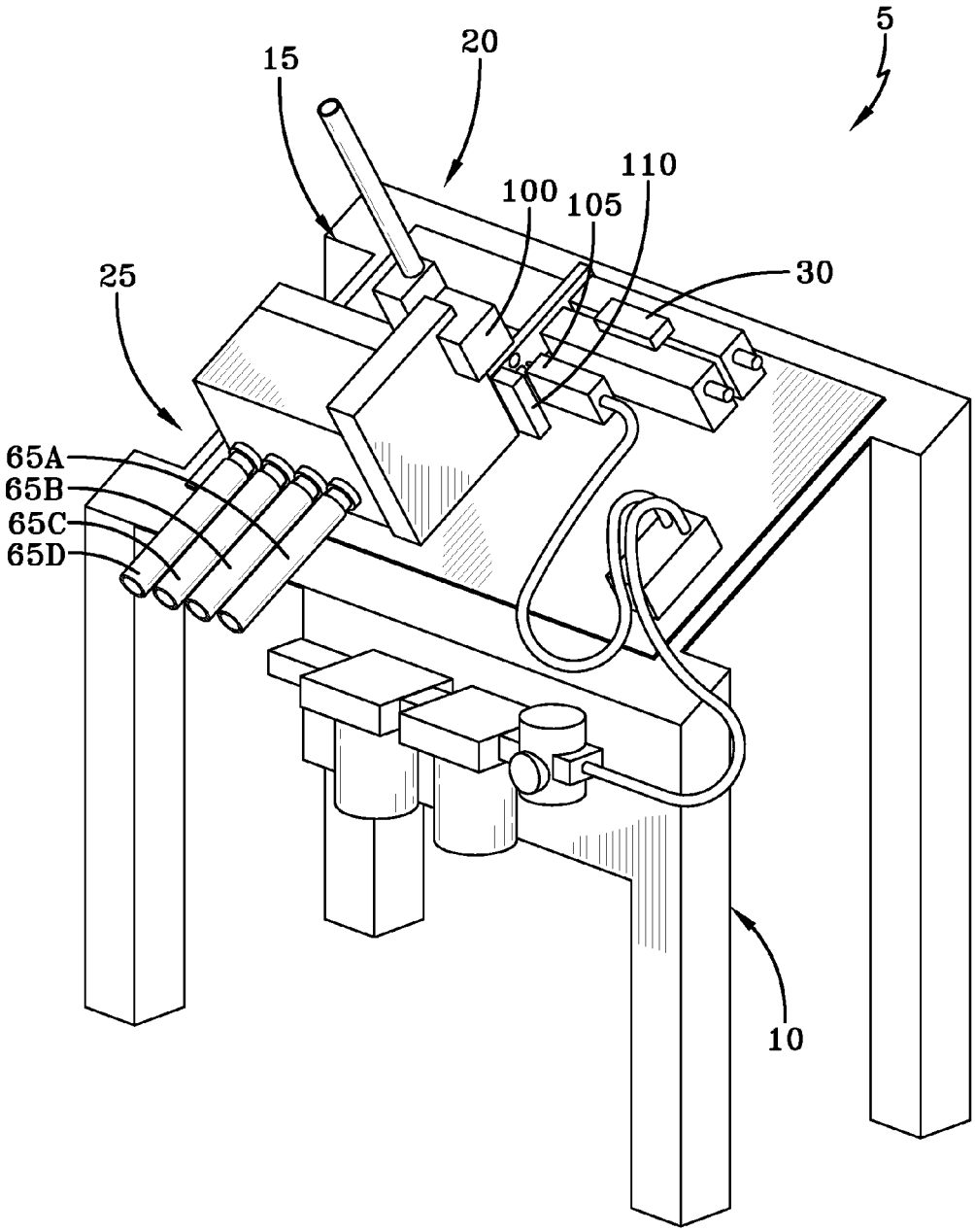
FIG. 1A is a front perspective view of one exemplary article sorting device of the present invention.

FIG. 1A is a front perspective view of one exemplary embodiment of an article sorting device 5 of the present invention. In this embodiment, the device 5 is shown to generally include a frame 10 that supports a loading portion 15 (including air solenoids), a sorting portion 20, and a discharge/distribution portion 25. Other embodiments may differ considerably in appearance, arrangement and/or size. As explained in more detail below, in this particular embodiment of the sorting device 5, articles to be sorted are loaded into a guide at the loading portion 15, whereafter the guide is linearly translated by an actuator 30 across a series of sorting apertures located in the sorting portion 20 such that the articles pass through corresponding sorting apertures and are transferred to proper locations (bins, etc.) by elements (e.g., sorting tubes 65) of the discharge/distribution portion 25. In this particular exemplary embodiment, the device 5 is used to sort articles of dissimilar length.

Figure 1B:
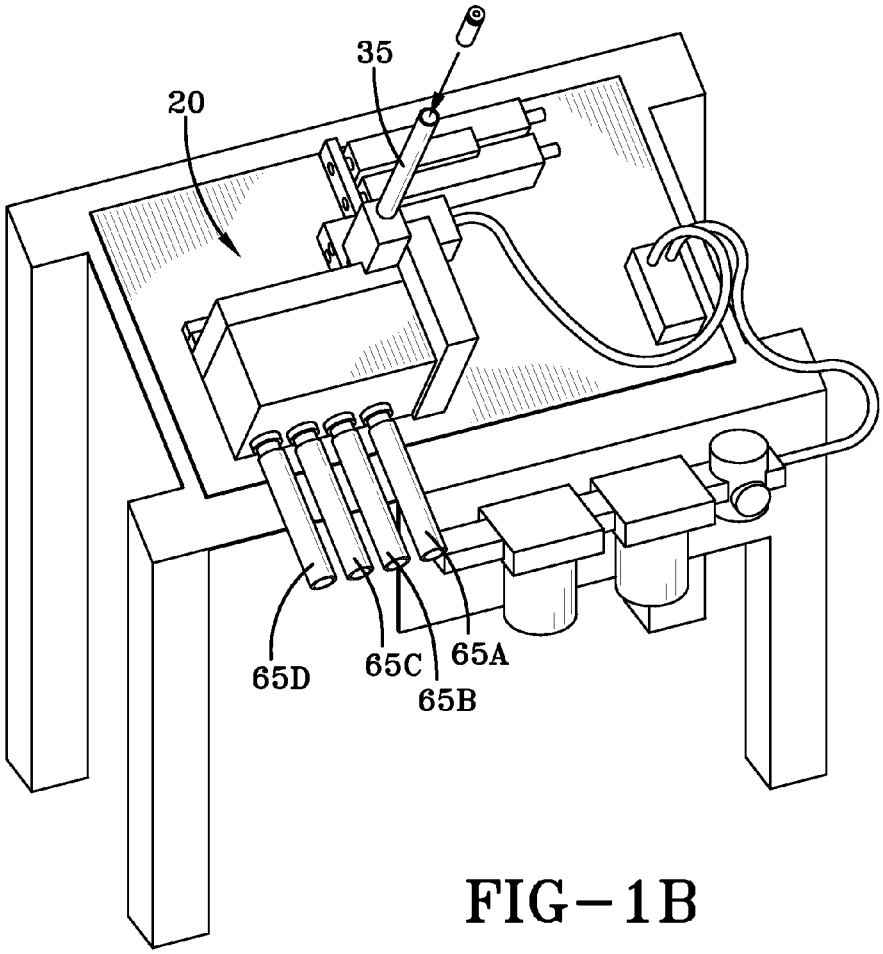
FIG. 1B depicts an article being placed into a loading tube that leads to a guide element of the device of FIG. 1A.

FIG. 1B is an enlarged front view of the loading portion 15 of FIG. 1A, wherein loading of an article to be sorted by means of a loading tube 35 is depicted. Specifically, a loading tube 35 is placed above a guide 40 (see FIGS. 3A-3C) to accept an article to be sorted and to direct the article into the guide 40. Other means for loading articles to be sorted to the device may be provided in other embodiments. For example, rather than manual loading, a device of the present invention may include an automatic feeder that automatically supplies the device with articles to be sorted from a vibratory bowl or some other receptacle that would be well known to those of skill in the art. The articles may be provided to the device by means of a supply tube or a similar element. The guide 40 then releasably retains the article as the guide is linearly translated across the sorting surface by the actuator 30.

In the embodiment shown, an air cylinder 100 maintains the next article to be sorted in a holding position where the article is prevented from dropping into the guide 40 until the guide returns to a starting position. Once the guide 40 has returned to the starting position, the guide actuates a limit switch 105 (FIG. 1A), which causes the cylinder 100 to release the next article into the guide. As the article enters the guide 40, it breaks a photo eye 110, which sends a signal that results in activation of the actuator 30 and movement of the guide and article.

Figure 2:
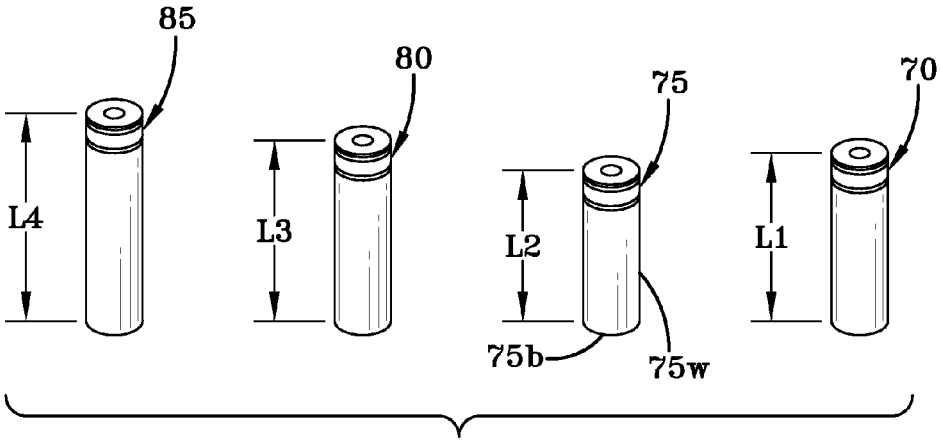
FIG. 2 is a perspective view of one embodiment of a plurality of articles of varying length to be sorted by the device of FIG. 1A.

FIG. 2 is a perspective view of a plurality of exemplary articles that vary in size. In this embodiment, a total of four different articles 70, 75, 80, 85 are shown, with each article varying in length from the shortest article 70 with a length L1 to the longest article 85 with a length L4. Although articles of four different lengths are shown, embodiments of the present invention may be designed to sort articles of more or less than four different lengths. In this particular embodiment, each article 70-85 has a base or bottom portion 70*b*-85*b* (as determined by the orientation of the article when loaded) and an outer wall portion 70*w*-85*w*. In some embodiments, the articles may be symmetrical, or may otherwise include a top or bottom surface that can be interchangeably used as the base portion.

As will be discussed further below in relation to exemplary embodiments of the device, articles to be sorted may have any number of different shapes/sizes. For example, although the articles 70-85 shown in FIG. 2 have a circular cross-section, the articles that may be sorted by devices of the present invention can have a variety of cross-sectional shapes and dimensions, including but not limited to rectangular, square, oval, triangular, hexagonal, octagonal, polygonal, or any combination of these shapes. Also, although the articles to be sorted are shown in FIG. 2 as having relatively similar cross-sections, devices of the present invention may be used to sort articles that have dissimilar cross-sectional shapes (e.g., some articles may have a rectangular cross-section while others may have a circular cross-section).

Figure 3A:
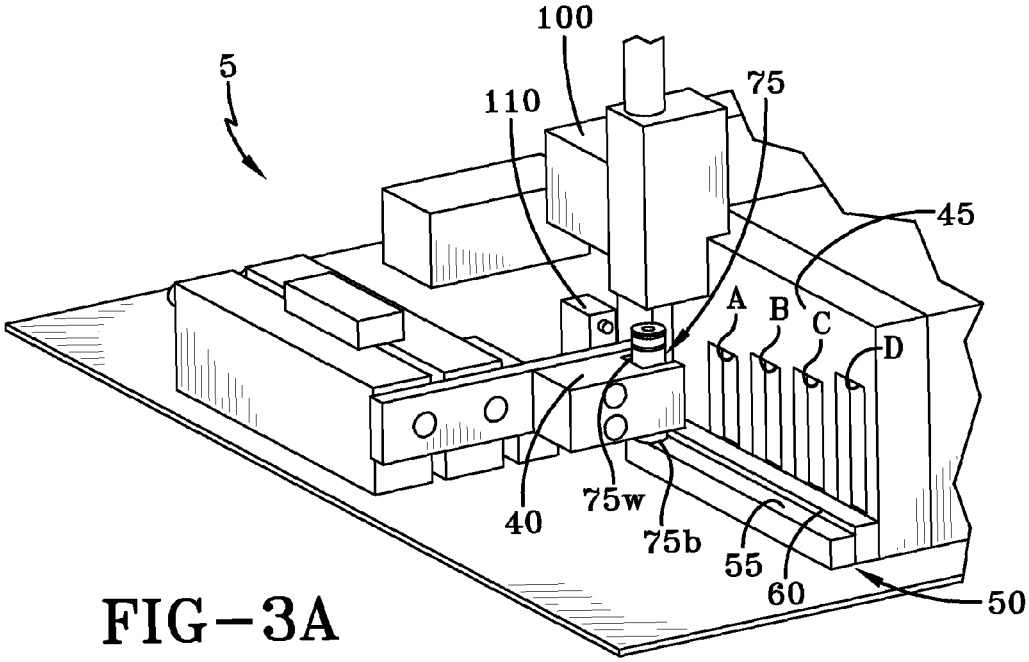
FIG. 3A is an enlarged top perspective view of a portion of the exemplary device for sorting the articles of FIG. 1A, where a guide element of the device is in the starting or beginning position.

FIG. 3A is a top perspective view of a portion of the exemplary sorting device 5 of FIG. 1A. As shown, the device 5 includes an article holding guide 40 that is moved by the actuator 30 (shown in FIG. 1A) so as to linearly translate a releasably held article 75 across an aperture sorting surface 45. The guide 40 is adapted to receive an article from a supply of articles to be sorted. In other embodiments of the present invention, a guide may be designed to simultaneously hold and transport more than one article to be sorted. The guide 40 is shown in a starting or initial position in FIG. 1A.

A support element 50 having a primary support surface 55 may extend from the sorting surface 45 to provide support for the article 75 being sorted along a base portion 75*b* thereof. Preferably, but not essentially, the apertured sorting surface 45 will generally be substantially perpendicular to the primary support surface 55—although such may not be desirable in all embodiments. In some embodiments, the support element 50 and sorting surface 45 may be a unitary element, while in other embodiments they may be separate elements that are affixed to one another. One or more surfaces of the support element 50 may also act as guideways for the guide 40 as it traverses the sorting surface 45. For example, the support element 50 may be a linear guide rail.

Figure 4:
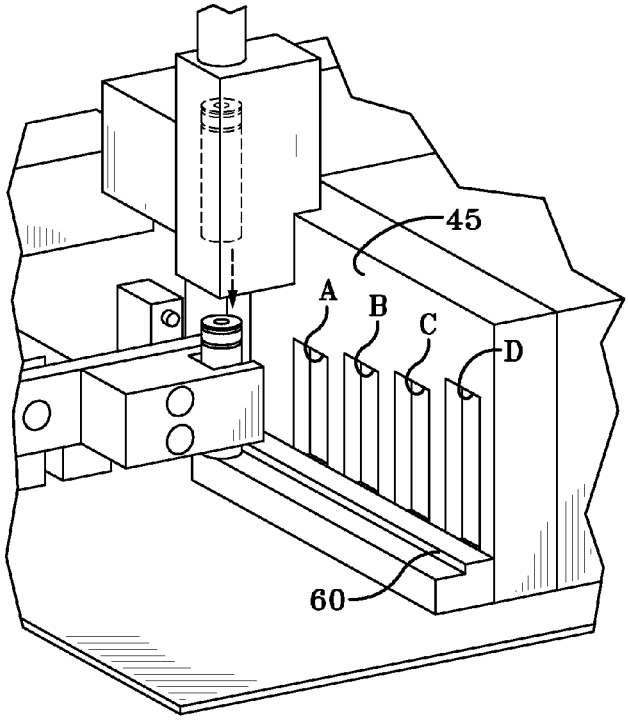
FIG. 4 is a top perspective view of a portion of another exemplary embodiment of a device for sorting articles like those shown in FIG. 2, where the guide element of the device is in the starting or beginning position.

A secondary support surface 60 may be provided to prevent an article from inadvertently passing through an incorrect aperture by a sliding along the bottom portion thereof. In certain embodiments, the secondary support surface 60 may be a part of and extend from the support element 50, such as by use of a section of structural angle or a similar material. In other embodiments, the secondary support surface 60 may be an integral portion of the sorting surface 45 itself (see FIG. 4). The height of the secondary support surface 60 may be the same or may vary along the length of the support element 50. In the exemplary embodiment shown, the secondary support surface 60 extends substantially normal or perpendicular from the primary support surface 55 and substantially parallel to the sorting surface 45. As described in more detail below, when a secondary support surface 60 like that shown herein is present, an article passes through a corresponding sorting aperture by tipping over the secondary support surface.

The apertured sorting surface 45 is shown to contain four sorting apertures A-D, each one of which is, in this case, sized to pass a particular one of the articles 70-85 shown in FIG. 2. Thus, like the articles 70-85, the apertures A-D are of four different heights (lengths). As shown, the apertures A-D are arranged from shortest to longest with respect to the direction of travel of the guide 40, such that an article to be sorted will fall through the correct aperture (i.e., the first aperture of sufficient length) and not an aperture intended for an article of greater length. In other embodiments of the present invention, a greater or lesser number of different sized apertures may be present depending on the particular articles to be sorted.

In the specific embodiment and view shown in FIG. 3A, the article 75 held by the guide 40 is of a length that corresponds with the second aperture B. That is, the second aperture B is the first of the four apertures A-D that is of sufficient length to permit passage of the article 75. Therefore, when the guide 40 and article 75 reaches the second aperture B, the article will fall from the guide and through the second aperture for appropriate sorting.

Figure 3B:
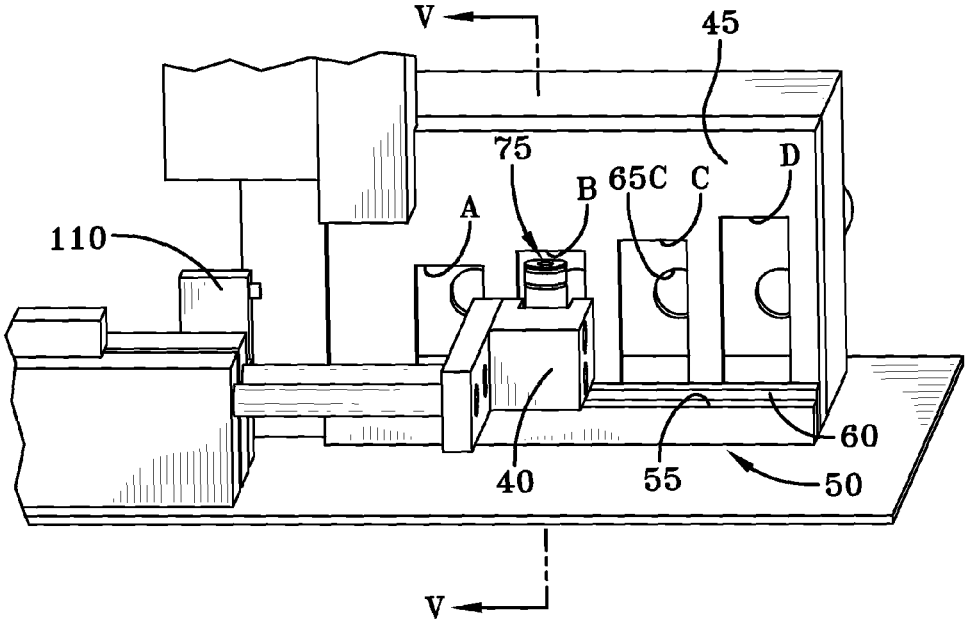
FIG. 3B shows the guide element of FIG. 3A travelling linearly across a second sorting aperture while carrying an article to be sorted.

FIG. 3B depicts the guide 40 and article 75 shown in FIG. 3A, with the guide and article travelling linearly across the second aperture B after having already passed over the first aperture A. As explained above, when the article 75 reaches this position, the article will fall through the second aperture B for sorting to a proper location. In this case, the article 75 is depicted just prior to falling through the second aperture B for purposes of illustration.

Figure 3C:
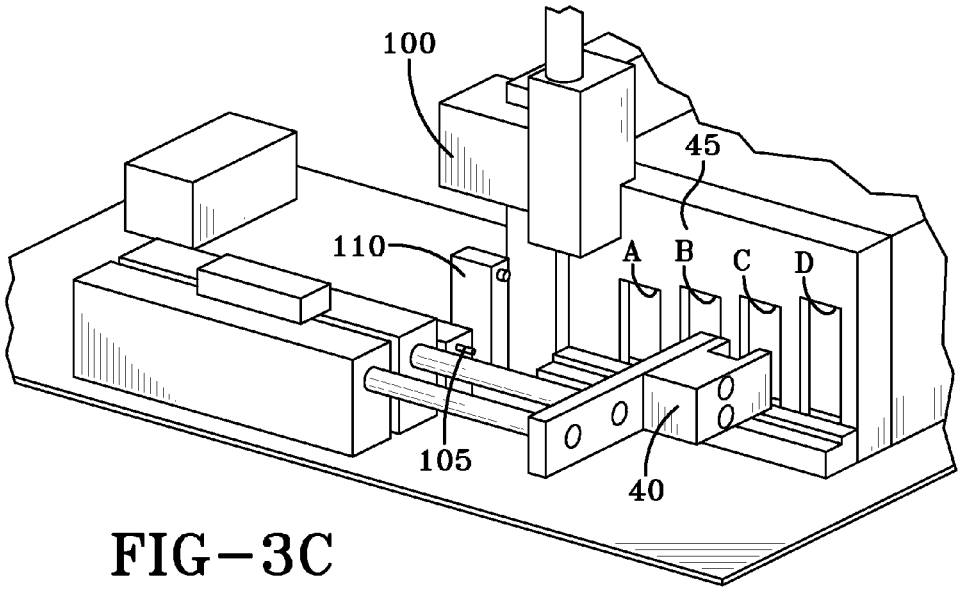
FIG. 3C shows the guide of FIGS. 3A-3B passing over a third sorting aperture.

In certain embodiments of a device of the present invention, the actuator may translate the article holding guide across all of the apertures present during each sorting cycle. This is represented in FIG. 3C, where the guide 40 is shown travelling linearly across the third aperture C without the article 75, which has already fallen through the second aperture B as described above with respect to FIGS. 3A-3B. As should be understood, in such an embodiment, the guide 40 would continue to travel in the same direction until passing over the fourth aperture D, whereafter the actuator 30 movement would be reversed and the guide returned to the start position of FIG. 3A where it is able to receive a next article to be sorted.

In other embodiments of the present invention, a sensor is provided (on the guide or otherwise) to detect when an article leaves the guide and/or passes through an aperture, through a directing element, into a sorting bin, etc., and to use a signal from such a sensor(s) to cause a resulting reversal of the actuator and a retraction of the guide. For example, in the particular exemplary embodiment shown and described herein, the photo eye 110 (shown in FIG. 1A) is triggered when an article leaves the guide 40 and passes through an aperture. A signal from the photo eye 110 is used to substantially immediately reverse the direction of the actuator 30 and to return the guide to its starting position. It should be apparent that such an embodiment would likely be able to sort articles more quickly than a counterpart device that simply passes the guide over all the apertures upon each operation.

In any event, it can be understood from FIGS. 3A-3C that the guide 40 travels substantially parallel to the sorting surface 45, with the article to be sorted releasably held in the guide and supported by the primary support surface 55 and the sorting surface or secondary support surface 60. In this manner, articles to be sorted may be translated over the provided sorting apertures of a sorting surface in a highly controlled and accurate manner. Thus, even articles having different but very similar dimensions may be accurately and repeatably sorted.

As mentioned briefly above, after passing through an intended aperture A-D, an article 70-85 may be directed into an exit or other directing element for deposit in a sorting bin/container or for transfer to another location and/or process. In this particular embodiment, sorting tubes (shown generally as 65 in FIG. 1*a*) are used for this purpose. A sorting tube 65A-65D is respectively associated with each of the sorting apertures A-D (see FIG. 1B). The entry to one of these sorting tubes 65C is visible at the back of the third aperture C in FIG. 3B. In this case, when an article 70-85 falls through an aperture A-D, the article subsequently passes into the associated sorting tube 65A-65D whereby the article is directed to a proper location (e.g., to a container, bin or other storage device, to a downstream process, etc.).

A sorting aperture A-D of a device 5 of the present invention may have a sorting dimension (e.g., height) that is slightly smaller than the sorting dimension (e.g., length) of a corresponding one of a group of given articles 70-85. For example, in the exemplary embodiments shown herein, each of the sorting apertures A-D has a length that is slightly less than the length (height) of the articles 70-85 that the apertures are designed to receive (i.e., aperture A is slightly shorter than the length L1 of article 70). Therefore, any reference herein to an aperture corresponding to an article to be sorted is not intended to mean that the aperture and the article have the same sorting dimension but, rather, that the aperture in question is closer in size to the sorting dimension of the given article than are the other apertures. The difference between the sorting dimension of the apertures and the sorting dimension of the articles to be sorted may vary from embodiment-to-embodiment depending on, for example, the number of dissimilar articles to be sorted, the difference in the sorting dimension of the articles to be sorted, etc.

Figure 5:
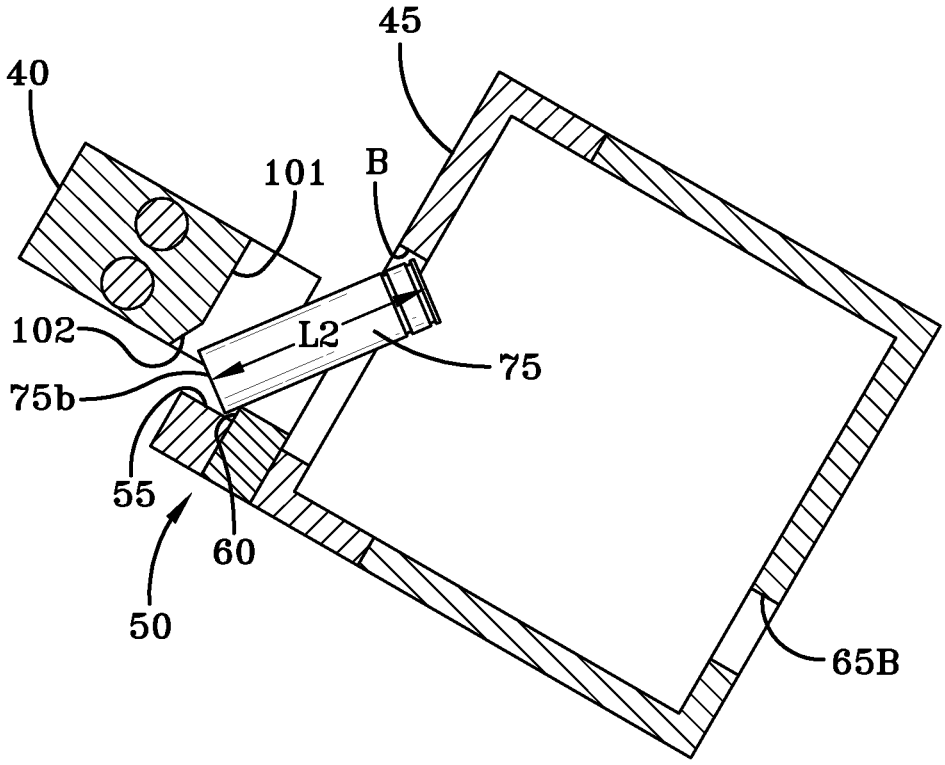
FIG. 5 is a cross-sectional view at line V-V of the exemplary device for sorting the articles of FIG. 3B showing the guide of FIGS. 3A-3B passing over a second sorting aperture while carrying an article to be sorted where the article is beginning to fall through the aperture.

Since the sorting apertures A-D of the exemplary embodiment have smaller dimensions (e.g., height) then the sorting dimensions (e.g, length) of the corresponding articles 70-85 it is necessary for the articles 70-85 to be tipped into the corresponding sorting apertures A-D. The tipping action of the article 75 is illustrated in FIG. 5. As shown in FIG. 5, the guide 40 defines a cavity 101 therein for receiving and releasably retaining an article 75 from a supply of articles 70-85 to be sorted. Article 75 passes through the cavity 101 and is supported by the primary support surface 55 of the support element 50 along a base portion 75*b* thereof. The cavity 101 has a flared portion 102 proximate to the support surface 55 of the support element 50. The flared portion 102 of the cavity 101 allows the article 75 to be tipped and pivot about the secondary support surface 60.

As shown in FIG. 5, the guide 40 and the article 75 have traveled linearly to the second aperture B after having passed over the first aperture A. When the article 75 reaches this position, the top portion of the article (i.e., the end opposite base portion 75*b*) starts to tip into the sorting aperture B in the sorting surface 45 and pivots about the secondary support surface 60. As the top portion of the article 75 enters the sorting aperture B, the base portion 75*b* of article 75 docks into the flared portion 102 of the cavity 101. Thereafter, the article 75 simply falls through the sorting aperture B. Although in the exemplary embodiment shown in FIG. 5 the force initializing the rotation of the article 75 is gravity due to the inclined arrangement, other exemplary embodiments may have a biasing means to force the top portion of the article 75 through the sorting aperture B.

The sorting surface 45 and the support surfaces 55 and 60 are preferably planar in order to produce a smooth translation of an article to be sorted. The support 55 and 60 and/or sorting surfaces 45 may also be constructed from a low friction material or coated with a friction-reducing material in order to facilitate movement of the articles to be sorted. Preferably, the sorting surface 45 also forms an angle of less than ninety degrees (see, e.g., FIG. 1A) with respect to the ground so that gravity can better assist with passing an article to be sorted through a corresponding sorting aperture A-D. The exact angle between the sorting surface 45 and the ground may vary from, for example, substantially parallel to the ground to almost perpendicular thereto.

While certain embodiments of the present invention are described in detail above, it is to be understood that the scope of the invention is not to be considered limited by such disclosure, and modifications are possible without departing from the spirit of the invention as evidenced by the following claims:

What is claimed is:

1. A device for sorting a plurality of articles that vary in size, the device comprising:

a sorting surface containing a plurality of sorting apertures, each of said sorting apertures corresponding to a particular one of a plurality of articles to be sorted;

a primary support surface associated with said sorting surface, said primary support surface provided to support an article to be sorted along a base portion thereof;

a guide that moves linearly along said sorting surface and adapted to receive and releasably retain articles to be sorted; and an actuator coupled to said guide and adapted to move said guide and a retained article linearly along said sorting surface and over said sorting apertures;

wherein, as said guide and said article are caused to traverse said sorting surface, an article retained by said guide will fall through the first sorting aperture of sufficient size to allow its passage.

2. The device of claim 1 wherein:

said plurality of apertures are arranged from smallest to largest along the travel path of said guide.

3. The device of claim 2 wherein:

said actuator moves said guide and a retained article from the smallest aperture to the largest aperture.

4. The device of claim 1 wherein:

said actuator is adapted to move said guide across all the apertures present in said sorting surface prior to retracting said guide to a starting position.

5. The device of claim 1 wherein:

said actuator is adapted to move said guide across said apertures until a retained article falls through an aperture, then to retract said guide to a starting position.

6. The device of claim 1 wherein:

an article to be sorted is further supported during linear movement of said guide by contact between said sorting surface and an outside wall of said article.

7. The device of claim 1 further comprising:

a secondary support surface that is substantially perpendicular to said primary support surface and substantially parallel to said sorting surface.

8. The device of claim 7 wherein:

an article to be sorted is further supported during linear movement of said guide by contact between said secondary support surface and an outside wall of said article.

9. A sorting device for sorting a plurality of articles that vary in size, the device comprising:

a sorting surface inclined at less than a perpendicular angle to the ground, said sorting surface containing a plurality of sorting apertures each of which correspond to a particular one of a plurality of articles to be sorted;

a primary support surface associated with and extending substantially parallel from said sorting surface, said primary support surface provided to support an article to be sorted along a base portion thereof;

a guide that moves linearly along said sorting surface and adapted to receive and releasably retain articles to be sorted;

an actuator coupled to said guide and adapted to move said guide and a retained article linearly along said sorting and primary support surfaces and over said sorting apertures such that an article retained by said guide will fall through the first sorting aperture of sufficient size to allow its passage; and a directing element connected to each sorting aperture for directing an article that passes through the associated aperture to a desired location.

10. The device of claim 9 wherein:

said plurality of apertures are arranged from smallest to largest along the travel path of said guide.

11. The device of claim 10 wherein:

said actuator moves said guide and a retained article from the smallest aperture to the largest aperture.

12. The device of claim 9 wherein:

said actuator is adapted to move said guide across all the apertures present in said sorting surface prior to retracting said guide to a starting position.

13. The device of claim 9 wherein:

said actuator is adapted to move said guide across said apertures until a retained article falls through an aperture, then to retract said guide to a starting position.

14. The device of claim 9 further comprising:

a secondary support surface that is substantially perpendicular to said primary support surface and substantially parallel to said sorting surface.

15. The device of claim 14 wherein:

said secondary support surface is an integral portion of said sorting surface residing below at least each of said plurality of sorting apertures.

16. The sorting device of claim 9 wherein:

said directing element is a sorting tube placed behind a respective sorting aperture, the sorting tube of a given aperture leading to a location different than that of any sorting tubes associated with other apertures.

17. The sorting device of claim 9 further comprising:

a loading element in communication with both said guide and a supply of articles to be sorted.

18. A sorting device for sorting a plurality of articles that vary in length, the device comprising:

a frame supporting a loading portion, a sorting portion and a distribution portion;

a sorting surface associated with said sorting portion, said sorting surface inclined at less than a perpendicular angle to the ground and containing a plurality of sorting apertures that correspond in length to the various articles to be sorted, said apertures arranged from shortest to longest along the travel path of the articles to be sorted;

a primary support surface running substantially the length of said sorting surface and extending substantially parallel therefrom, said primary support surface provided to support an article to be sorted along a base portion thereof;

a guide associated with said loading portion, said guide moving linearly along said sorting surface and adapted to receive and releasably retain articles to be sorted:

an actuator coupled to said guide and adapted to move said guide and a retained article linearly along said sorting surface and over said sorting apertures while a base portion of said article slides on said primary support surface, such that an article retained by said guide will fall through the first sorting aperture of sufficient size to allow its passage; and a directing element connected to each sorting aperture for directing an article that passes through the associated aperture to a desired location.

19. The sorting device of claim 18 wherein:

said actuator is adapted to move said guide across all the apertures present in said sorting surface prior to retracting said guide to a starting position.

20. The device of claim 18 wherein:

said actuator is adapted to move said guide across said apertures until a retained article falls through an aperture, then to retract said guide to a starting position.

21. A method of sorting a plurality of articles that vary in length, the method comprising:

providing a sorting device, said sorting device further comprising:

a frame supporting a loading portion, a sorting portion, and a distribution portion;

a sorting surface associated with said sorting portion, said sorting surface inclined at than a perpendicular angle to the ground and containing a plurality of sorting apertures that correspond in length to the various articles to be sorted, said apertures arranged from shortest to longest along the travel path of the articles to be sorted;

a primary support surface running substantially the length of said sorting surface and extending substantially parallel therefrom, said primary support surface provided to support an article to be sorted along a base portion thereof; and a guide associated with said loading portion, said guide moving linearly along said sorting surface and adapted to receive and releasably retain articles to be sorted;

moving said guide of said sorting device and a retained article linearly along the sorting surface and over said sorting apertures while a base portion of said article slides on said primary support surface, such that an article retained by said guide will fall through the first sorting aperture of sufficient size to allow its passage; and directing an article that passes through the associated aperture of said sorting device to a desired location.

22. The method of claim 21, further comprising moving said guide of said sorting device across all the apertures present in said sorting surface prior to retracting said guide to a starting position.

23. The method of claim 21, further comprising moving said guide of said sorting device across said apertures in said sorting surface until a retained article falls through an aperture, then retracting said guide to a starting position.

* * * * *

UNITED STATES PATENT AND TRADEMARK OFFICE

CERTIFICATE OF CORRECTION

PATENT NO. : 8,469,200 B2
APPLICATION NO. : 13/069441
DATED : June 25, 2013
INVENTOR(S) : Wendeln It is certified that error appears in the above-identified patent and that said Letters Patent is hereby corrected as shown below:

On the title page, item (56) References Cited, U.S. Patent Documents, please add
-- 3,498,452 3/1970 Aronstein et al. --.

Signed and Sealed this
Twentieth Day of August, 2013

Teresa Stanek Rea
*Acting Director of the United States Patent and Trademark Office*